US008429908B2

(12) United States Patent
Bauer

(10) Patent No.: US 8,429,908 B2
(45) Date of Patent: Apr. 30, 2013

(54) HYDRAULIC SYSTEM

(75) Inventor: Wolfgang Bauer, Weinheim (DE)

(73) Assignee: Deere & Company, Moline, IL (US)

( * ) Notice: Subject to any disclaimer, the term of this patent is extended or adjusted under 35 U.S.C. 154(b) by 719 days.

(21) Appl. No.: 12/640,588

(22) Filed: Dec. 17, 2009

(65) Prior Publication Data

US 2011/0146259 A1 Jun. 23, 2011

(51) Int. Cl.
*F16D 31/02* (2006.01)
*F01B 3/00* (2006.01)
*F15B 15/24* (2006.01)

(52) U.S. Cl.
USPC ..... 60/449; 91/506; 92/13.6

(58) Field of Classification Search ..... 60/431, 60/443, 449; 91/506; 92/12.2, 13.6, 13.7, 92/13.8
See application file for complete search history.

(56) References Cited

U.S. PATENT DOCUMENTS

| | | | | |
|---|---|---|---|---|
| 6,655,135 | B2 * | 12/2003 | Oka | 60/449 |
| 7,353,651 | B2 * | 4/2008 | Adkins et al. | 60/449 |
| 7,398,648 | B2 * | 7/2008 | Tatsuno et al. | 60/449 |

FOREIGN PATENT DOCUMENTS

| | | |
|---|---|---|
| DE | 3540218 | 5/1986 |
| DE | 4304403 | 8/1993 |
| DE | 4440304 | 7/1995 |
| DE | 10032077 | 11/2001 |
| EP | 0832360 | 1/1998 |

OTHER PUBLICATIONS

German Search Report, (5 pages).
German Search Report, Aug. 7, 2012, 5 pages.

* cited by examiner

*Primary Examiner* — Michael Leslie

(57) ABSTRACT

A hydraulic system includes an engine driven variable displacement hydraulic pump which supplies fluid to a hydraulic consumer and an electronic control unit. A flow rate adjusting unit includes a stop that can be brought into engagement with an adjusting piston. In order conform the power output of the pump to the operating conditions of the vehicle, the stop of the flow rate adjusting unit includes adjusting devices that can be controlled by the control unit, so that the maximum flow rate of the pump can be varied by the electronic control unit. The electronic control unit generates a control signal for the adjusting device as a function of a sensed engine speed.

5 Claims, 2 Drawing Sheets

HYDRAULIC SYSTEM

FIELD OF THE INVENTION

The present invention relates to a hydraulic system with an engine driven adjustable or variable displacement hydraulic pump which supplies hydraulic fluid to a hydraulic consumer under the control of an electronic control unit.

BACKGROUND OF THE INVENTION

Many types of agricultural or construction machines, such as tractors or telescopic loaders, have a hydraulic system which includes a hydraulic consumer, such as a hydraulic cylinder or hydraulic motor or other hydraulically driven components. Such hydraulic systems include hydraulic pumps that are connected with a drive shaft of the engine directly or over a rigid connecting gearbox that can be shifted into a fast or slow gear ratio. Thereby the maximum volume flow of the hydraulic pump varies with the rotational speed of the engine. The more rapidly the engine rotates, the larger is the pump flow rate. With adjustable or variable displacement hydraulic pumps, the maximum flow rate may be made to conform to the demand of the hydraulic consumer. This is usually performed by means of a flow rate controller which controls or maintains a predetermined control pressure difference between the pressure at the outlet of the pump and the load sense (LS) signal reported by the consumer. The flow rate controller of an LS controlled pump operates so that it controls the flow rate of the pump so that the predetermined control pressure difference that can be adjusted in a fixed manner by means of an adjusting spring and is maintained as a constant value at all times. The operation of such a pressure/flow rate controller is well known in the state of the art.

The flow rate that can be delivered by a hydraulic valve to a hydraulic cylinder or a hydraulic motor is a direct function of this control pressure difference. A certain control pressure is adjusted by means of the adjusting spring and an adjusting piston of a flow rate controller in that it forces the pump to maintain a control pressure difference corresponding to this adjusted pressure between the outlet of the pump and the LS signal. In order to attain this control pressure difference it pivots the flow rate control adjusting member to begin to convey a corresponding flow rate that can be controlled or adjusted as a function of the adjusting piston. The adjusting piston is connected hydraulically with the flow rate controller and changes its position as a function of the control pressure difference existing or provided as input at the flow rate controller. The flow rate control unit may for example include a pivoting disk that is connected with a control or lifting piston where the rotating movement of the pivoting disk is converted into a linear movement of the lifting piston. The flow rate conveyed by the pump flows through the lines and the valves of the hydraulic system and thereby generates certain pressure losses in the lines and in each of the valves leading to the consumer. The pressure that then develops behind the valves or at the consumer is transmitted back to the pump over a load pressure line that is connected with the flow rate controller, and induces the pump to convey as much volume flow as needed so that the pressure at the outlet of the pump is higher by the control pressure difference as the load pressure at the consumer delivered by the L-S signal.

The further a valve is distant from the pump, the larger will be the pressure losses due to the longer flow distance, which results in the effect that valves that are further removed from the pump as compared to other valves permit less volume flow to reach a consumer although these are valves of the same configuration. In order to compensate for this effect, known practice is to apply valves that report a re-enforced load signal to the pump, as is disclosed in EP 176 0 325 A2.

Accordingly, a certain pressure is required to force a certain volume flow through a line or a valve. Since the pressure losses increase with the volume flow, it would be advantageous to maintain the cross section of the lines and bores as large as possible and to keep the losses as small as possible in the configuration, if a certain amount of hydraulic fluid is to be made available to a consumer. If the losses now become too great and the volume flow is thereby reduced, this can be compensated for by enlarging the cross section at the valve openings, that is, volume flows can be changed; they can be increased or decreased by changes in the cross section at the valve openings.

Other possibilities of changing the volume flow aim at changing the adjusting force acting on the flow rate controller of the pump. In this way, EP 0 439 621 B1 discloses that for a precision operation of the hydraulic system, the control pressure difference at the pump can be reduced by manual operation of an adjusting force at the flow rate controller, this results in lower maximum volume flow in the hydraulic system or in the valves.

Now the problem is that it may be advantageous for environmental and economic reasons to operate a hydraulic system of an operating machine in the lower rotational speed range of the engine. This has the result that too little volume flow is then conveyed with today's pump sizes that are available for the application, which in turn leads to the application of larger pumps, so that at low engine rotational speeds large volume flows can be conveyed. As a result, at high engine rotational speeds, very large volume flows are conveyed (that cannot be reduced), and this leads to very large power losses in the overall power balance. These problems could be overcome, at least partially, by increasing the control pressure difference of the pump which finally would result in increased fuel consumption for the machine, since a certain power output is required or a certain volume flow is required in order to attain the control pressure difference. Moreover, there is the possibility of designing all lines and valves for the maximum pump conveying power, which would lead in turn to very high costs for the individual components and to space problems on the operating machine. EP 349 092 B1 discloses a further possibility to permit higher volume flows at low engine rotational speeds, but to limit the volume flow at high engine rotational speeds. Here the maximum volume flow conveyed by the pump is limited, so that the flow rate of the pump is measured and monitored, for example, by measuring the position of the flow rate adjusting mechanism, such as the adjustment angle of an adjusting disk or a pivoting disk. Such pumps and the corresponding electronic controls however are costly and expensive.

SUMMARY OF THE INVENTION

Accordingly, an object of this invention is to provide a hydraulic system which makes available a high flow rate at low engine rotational speeds, but that is limited to a certain maximum value at high engine rotational speeds.

This and other objects are achieved by the present invention, wherein a hydraulic system includes a flow control member for adjusting a flow of the pump. The flow control member is coupled to a piston, and the piston is engagable with a stop. The stop is controlled by an adjusting device which can be controlled by the control unit as a function of sensed engine speed. A predetermined maximum flow rate of the pump can be changed purposefully at the flow rate adjusting unit as a function of the engine speed so that with increasing engine speed the maximum flow rate conforms proportionally and a maximum flow rate is not exceeded.

Thus, at low engine rotational speeds the control pressure difference is equal, for example, to P=P1 bar. Correspondingly, the adjusting piston of the flow rate adjusting unit that is connected hydraulically to the flow rate controller is adjusted. This adjustment is appropriate, for example, to convey a volume flow up to V1 per minute (V1/min) through the valves. However, the pump has the possibility of conveying volume flows up to Vmax/min on the basis of its maximum conveying capacity, which would generate high losses in the lines and valves. At idle rotational speeds this pump conveys, for example, the maximum of Vidle/min (Vidle<V1<Vmax) and with increasing rotational speed (U+) the volume flow (V) increases when the flow rate remains constant. Now it is conceivable that when the V1/min limit has been reached the stop of the adjusting piston of the flow rate adjusting unit is repositioned as a function of the engine speed, in such a way that the flow rate is reduced, so that at maximum engine speed of, for example, maximum rotational speed Umax U/min that V (1)/min as maximum volume flow can be conveyed by the pump. With respect to the pivoting disk of a flow rate adjusting unit this would mean that the maximum pivot angle of the pivot disk is reduced. If the engine speed is again lowered, the maximum flow rate is again increased, where the maximum pivot angle of the flow rate adjusting unit or of the pivot disk is again increased with lower engine speeds, until the original value has again been reached when the V1/min has again been reached. The corresponding functions and calculation algorithms are preferably stored in memory in the electronic control unit. A corresponding control signal is generated by the electronic control unit and conducted to the adjusting devices of the stop of the adjusting piston of the flow rate adjusting unit for the purposes of the control of the same. By controlling the adjusting devices the maximum flow rate of the pump is controlled variably as a function of the engine speed.

When a predetermined engine speed is exceeded, the maximum flow rate of the pump can be reduced by controlling the adjusting devices at the stop of the adjusting pistons. The predetermined engine speed value that triggers the adjustment of the maximum flow rate can be provided as input depending upon the application preferable over an input module of an operator's display of an operating implement or any other appropriate input interface of the control unit. Depending on the maximum power output of the pump, a fixed engine speed value may already have been provided as input and stored in memory in the control unit.

When a predetermined engine speed is exceeded the maximum flow rate of the pump is changed by controlling the adjusting devices at the stop of the adjusting piston in proportion to the engine speed, where the control unit reduces the maximum flow rate with increasing engine speed and increases it with reducing engine speed. With respect to this the control signal generated by the control unit conforms preferably continuously to a engine speed, so that the operator of the system does not directly sense the change in the maximum flow rate.

Moreover for special applications provision is made to utilize the highest maximum volume flow of the pump. For this purpose, adjusting devices are provided as a function of which the control signal can be modified, and the stop of the adjusting piston can be changed by means of the adjusting devices, in such a way that the maximum flow rate of the pump can be increased regardless of the engine speed (or subsequently reduced again). In that way an operator can quasi "override" the control taken over from the control unit of the adjusting devices of the flow rate adjusting unit or at the stop of the adjusting piston and deactivate the control function of the control unit dependent upon the engine speed, by corresponding inputs at the adjusting devices, for example on an input module or at an input button with an adjusting wheel or a potentiometer, and modify the control signal by the direct input of an input signal, so that despite the generation of a control signal proportional to the engine speed, the signal that is provided as input to the adjusting devices is prioritized. Thereby it is possible to circumvent a control dependent upon the engine speed and to operate the hydraulic system with a large flow rate or to adjust any desired flow rate at each desired engine speed. There are particular applications in which the operator would desire to utilize the total pump capacity without regard to the power losses. One such application would be, for example, the operation of a front loader, in which the operator would like to attain the shortest possible cycle time and therewith more cyclic power. In such a case an pump with large flow rate would not help very much unless all lines and valves are increased to the same degree. Here it may then be useful to purposefully raise the maximum flow rate by a corresponding readjustment of the stop of the adjusting piston, in order to assure that the pump, or the flow rate adjusting unit of the pump or the swash plate can pivot fully, in order to deliver a greater flow rate.

Moreover, the hydraulic system may include a temperature sensor that detects the temperature in the hydraulic system and delivers a corresponding signal to the control unit. In particular, since the viscosity of the hydraulic fluid is a function of the temperature, it may be advantageous to readjust the maximum flow rate, for example, to increase it as a function of the viscosity or the temperature at low temperatures or high viscosity of the hydraulic fluid. Moreover, it may be advantageous to counteract cavitations problems due to increased viscosity resulting from extremely low temperatures, so that the maximum flow rate is limited or is reduced and an increase takes place only at a certain temperature, in particular, dependent upon or independent of the engine speed. By the same token, it may be advisable to make the maximum flow rate conform to the lower flow losses at higher temperatures, that is, for example, to reduce it. In that way operating conditions may occur in the hydraulic system as a function of the engine speed as well as a function of the temperature for which a readjustment of the maximum flow rate may be advantageous. Corresponding control functions or control algorithms may be implemented in the electronic control unit and stored in memory as corresponding condition diagrams. On the basis of these control functions or control algorithms, corresponding control signals can be generated for the control of the adjusting devices, or for the relocation of the stop as a function of the engine speed alone, as well as in conjunction with a function of the temperature.

The adjusting device for adjusting the position of the stop of the adjusting piston is preferably an electric motor which is controlled by the control unit. Moreover, an electromagnet could readjust the position of the stop. Preferably, the readjustment of the stop should occur directly, for example, by means of a stepper motor that is connected to a spindle drive, which converts a rotary movement of the motor into a linear movement of a spindle whose end can operate as a stop for the adjusting piston. The adjusting piston in turn either represents a stop for the flow rate control member (for example, for the swash plate) or it moves such a stop into a position through which the pivot angle of the flow rate adjusting unit can be readjusted or limited. As previously noted this readjustment can be performed electrically or electromagnetically, but also hydraulically, pneumatically or purely mechanically, where an electric or electromagnetic readjustment of the stop of the adjusting piston is preferred, since this is easier to handle than other means of readjustment. Now the readjustment of the stop can increase or decrease the maximum flow rate of the pump. The readjustment can also be performed, for example, by means of a proportional magnet that is effective in both directions. It is also conceivable that an adjustment in only one direction could be permitted. Since there always is a chance that the electronics on the operating vehicle fails, it is useful to provide measures that prevent a failure of the entire hydraulic system in case of a failure of the electronics. For this reason the application of a stepper motor is particularly appropriate for the repositioning of the stop of the adjusting piston. The stepper motor has the advantage that it has a certain degree of self locking and can be repositioned very precisely into a certain position (angle of rotation) which it does not leave unless it receives a new control signal or a very strong force is applied to it. Such a stepper motor can be connected, for example, to an adjusting spindle for the repositioning of the maximum stroke of an adjusting piston of a flow rate adjusting unit and can rotate this adjusting spindle very precisely and rapidly as a function of the control signal, so that the position of the adjusting piston and with it the maximum pivot angle of the swash plate of the flow rate control unit or the maximum flow rate of the pump can be readjusted with great sensitivity. Here the adjusting spindle or the end of the adjusting spindle that engages the adjusting piston represents the stop of the adjusting piston. If the electronics should fail, the stepper motor would simply remain stopped in its last position and thereby provide the assurance that at least a certain minimum operation of the hydraulic system is possible.

This hydraulic system optimally operates in all operating conditions of the vehicle that depend upon the drive and is used in particular for the reduction of power losses and for making available large flow rates at low engine speed. Moreover, existing smaller line cross sections and valves can be used despite an pump with a large flow rate. If necessary very large flow rates are possible despite smaller line cross sections and valves. The retention of the existing valves and lines is thereby possible, despite the use of a larger pump. Moreover, in case of failure of the electrical system assurance can be provided that the existing hydraulic system remains available despite electronic control of the flow rate controller.

DESCRIPTION OF THE PREFERRED EMBODIMENT

Figure 1:
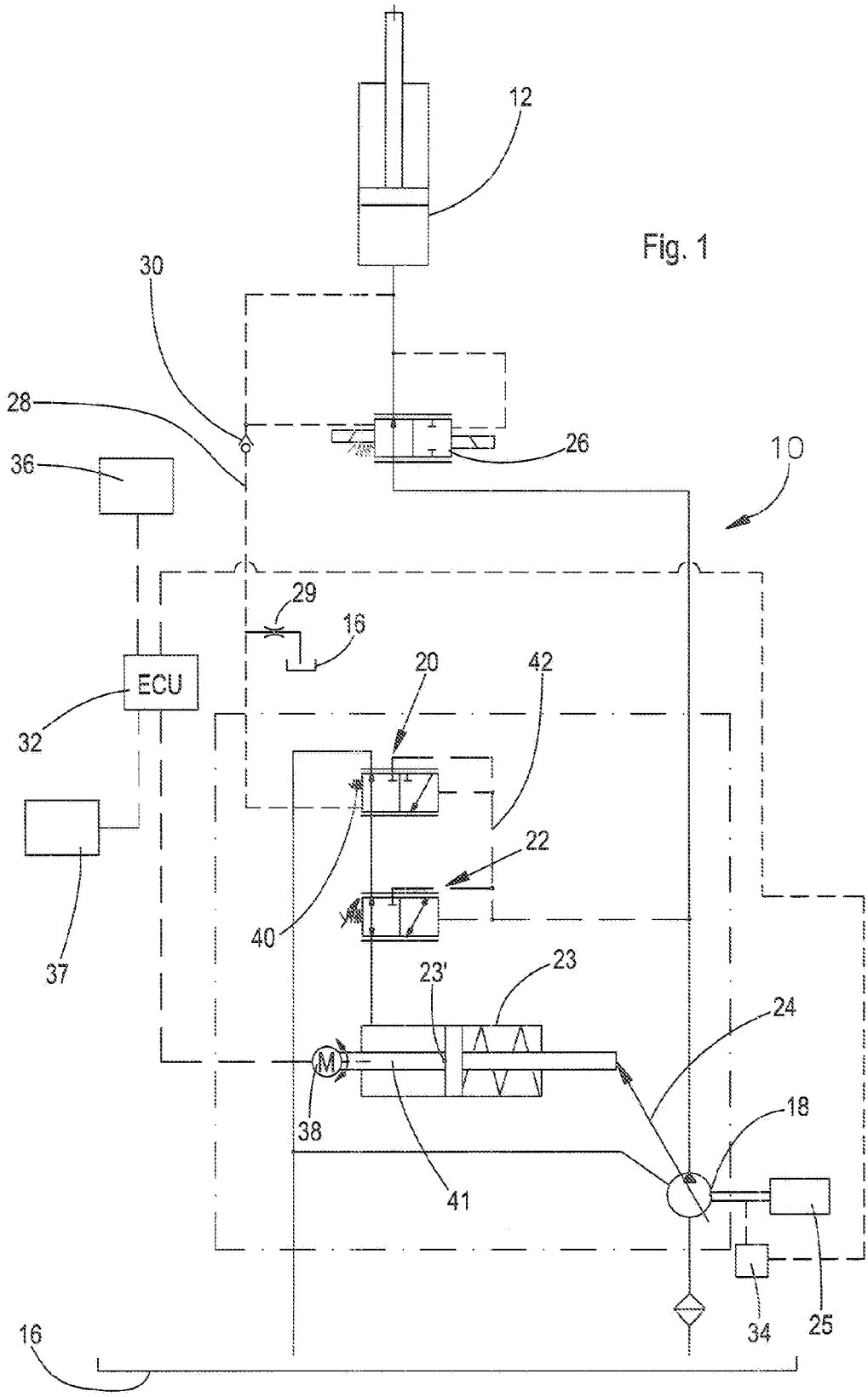
FIG. 1 is a hydraulic circuit diagram of a hydraulic system according to the invention.

Referring to FIG. 1, the hydraulic system 10 supplies hydraulic fluid to a hydraulic consumer, such as a hydraulic cylinder 12, which lifts and lowers a front loader 14. The hydraulic system 10 includes a hydraulic reservoir 16, an adjustable or variable displacement hydraulic pump 18 with a flow rate controller 20 for the adjustment of a control pressure difference between the pump 18 and the cylinder 12, a pressure limiter 22 for the limitation of the operating pressure for the pump 18. The displacement of pump 18 is controlled by control or adjusting member 24, which is controlled by piston 23. Piston 23 engages a stop 23' which limits the maximum displacement of the pump 18. The pump 18 is driven by an engine 25. A hydraulic control valve 26 controls communication between the cylinder 12 and the pump 18. A load pressure line 28 is connected between the cylinder 12 and the control valve 26, which is connected to the flow rate controller 20, where the load pressure line 28 is provided with a pressure reduction orifice 29 connected to the hydraulic reservoir 16 and a check valve 30 closing in the direction of the cylinder 12, where the check valve 30 is arranged between the pressure reduction orifice 29 and the cylinder 12. Moreover the hydraulic system 10 is equipped with an electronic control unit 32 that is connected to a rotational speed sensor 34 and an operator control 36. Furthermore, a temperature sensor 37 is provided that detects the temperature of the hydraulic fluid in the hydraulic system 10 and delivers a corresponding signal to the electronic control unit. The stop 23' of the adjusting piston 23 of the flow rate control member 24 is equipped with adjusting devices 38 that are configured as an electric motor, preferably as a stepper motor and are controlled by the electronic control unit 32. In place of the electric motor 38 shown in FIG. 1, for example, an electromagnetic proportional magnet (not shown) can be applied. The proportional magnet is preferably also effective in both directions, where generally a readjustment of the flow rate control member 24 in only one direction is feasible throughout, so that, for example, only one reduction of the maximum flow rate becomes possible.

The engine 25 is connected directly to the pump 18, or by reduction gears or stepper gears (not shown). The engine 25, is preferably an internal combustion engine, but may also be an electric motor. The drive shaft of the engine 25 is connected directly to the rotational speed sensor 34, which transmits an engine speed signal to the electronic control unit 32. Moreover, the electronic control unit 32 can receive input signals from the operator control 36, which it then considers for the generation of an adjusting signal for the adjusting devices 38. Only one rotational speed signal generated by the rotational speed sensor 34 is considered primarily as a function of which the electronic control unit 32 generates a control signal for the adjusting devices 38. If, however, an additional input is provided by the operator control 36, then the control signal based upon the rotational speed signal is modified correspondingly. Thus, an operator can provide a signal over the operator control 36 so that no control of the adjusting devices 38 depending upon rotational speed is to occur at the flow rate adjusting member 24, but rather control magnitudes provided by the operator are to be used for the control of the adjusting devices 38. For example, the operator can use operator control 36 to input the maximum flow rate for the pump 18 which is thereby adjusted independently of the engine speed by the electronic control unit 32.

The flow rate controller 20 is readjusted with a preload spring 40 with a fixed control pressure difference. Depending on the existing pressure relationships, a pressure difference develops between the control valve 26 and the cylinder 12 and the system pressure existing at the outlet of the pump, which is provided as input to the flow rate controller 20 over the load-sensing pressure line 28 and a control pressure line 42 connected to the outlet of the pump 18. According to the pre adjusted control pressure difference the adjusting piston 23 is connected over the pressure limiter 22 to the flow rate controller 20 and is brought into a corresponding control position (lifting position). The flow rate adjusting member 24 of the pump 18 in turn is adjusted according to the control position of the adjusting piston 23. In that way, the control pressure difference at the flow rate controller 20 of the pump 18 is controlled or regulated so that the adjustable piston is forced into a control position (lifting position) that is subject to the pressure relationships existing in the flow rate controller 20.

The control pressure difference at the flow rate controller 20 can be controlled by means of the preload spring 40, so that the control pressure difference can be adjusted by means of the adjusting devices 38 connected to the preload spring 40. The adjusting piston 23 can be limited in its position by means of a spindle drive 41, where one end of the spindle drive 41 or the spindle is connected with the adjusting devices 38 and the other end is used as a stop 23' for the adjusting piston 23. Here the adjusting piston 23 is limited in its ability to be shifted by means of the stop 23' of the spindle drive 41, where the limitation determines the maximum flow rate of the pump 18 by means of the stop 23'. Therefore the stop can be repositioned by means of the spindle drive 41 or can be shifted longitudinally in its position, where the maximum shifting path (lift path) of the adjusting piston 23 is provided as input by means of the spindle drive 41 or by means of the stop 23'. Moreover, the adjusting piston 23 is also connected with the flow rate control member 24, for example, by means of a pivoting disk (not shown) and limits due to its maximum ability to be shifted longitudinally the maximum lift value of the control piston of the pump 18, for example, by limiting the maximum pivot angle of the pivoting disk, so that a control of the adjusting devices 38 can be performed as a function of the signal delivered by the rotational speed sensor 34, a control of the adjusting devices 38, the stop 23' of the adjusting piston 23 of the flow rate control member 24 and with it a readjustment of the maximum flow rate of the pump 18 can also be performed.

Preferably, for that purpose threshold values are stored in memory in the electronic control unit 32, on the basis of which a corresponding control program can be executed, so that, for example, after reaching a predetermined rotational speed with the engine 25, the maximum flow rate of the pump 18 is continuously reduced as a function of the further increasing rotational speed, in order to limit the maximum flow rate. If now the maximum flow rate of the pump 18 is exhausted, then this could mean a direct control or regulation of the flow rate, since then the result is that the maximum conveyed volume of the pump 18 is limited in its flow rate by the stop 23' of the adjusting piston 23.

By means of the operator control 36 the operator can now "level off" or "over steer" the predetermined threshold values, so that a control of the adjusting devices 38 can now be performed independently of the rotational speed by the operator control 36. For example, the maximum flow rate can be maintained constant by means of the operator control 36, where then the control unit 32 performs the control of the adjusting devices 38 independently of the rotational speed of the engine 25. Here the operator control 36 can include several switches or an input display or an adjustable potentiometer with which corresponding adjusting magnitudes may be provided as input. Moreover, an activation or deactivation of the control that depends on the rotational speed of the flow rate adjusting member 24 can now be performed by the operator control 36.

As already noted, the temperature sensor 37 detects the temperature of the hydraulic fluid and delivers a corresponding temperature signal to the control unit 32. The control unit 32 can now change or control or regulate the maximum flow rate as a function of the engine speed as well as a function of the temperature by repositioning the stop 23'. In that way the maximum conveyed volume can be reduced or increased in addition as a function of the temperature of the hydraulic fluid of the hydraulic system. Corresponding control signals are generated by control functions or control algorithms implemented in the control unit 32 as a function of the engine speed and/or the temperature.

Figure 2:
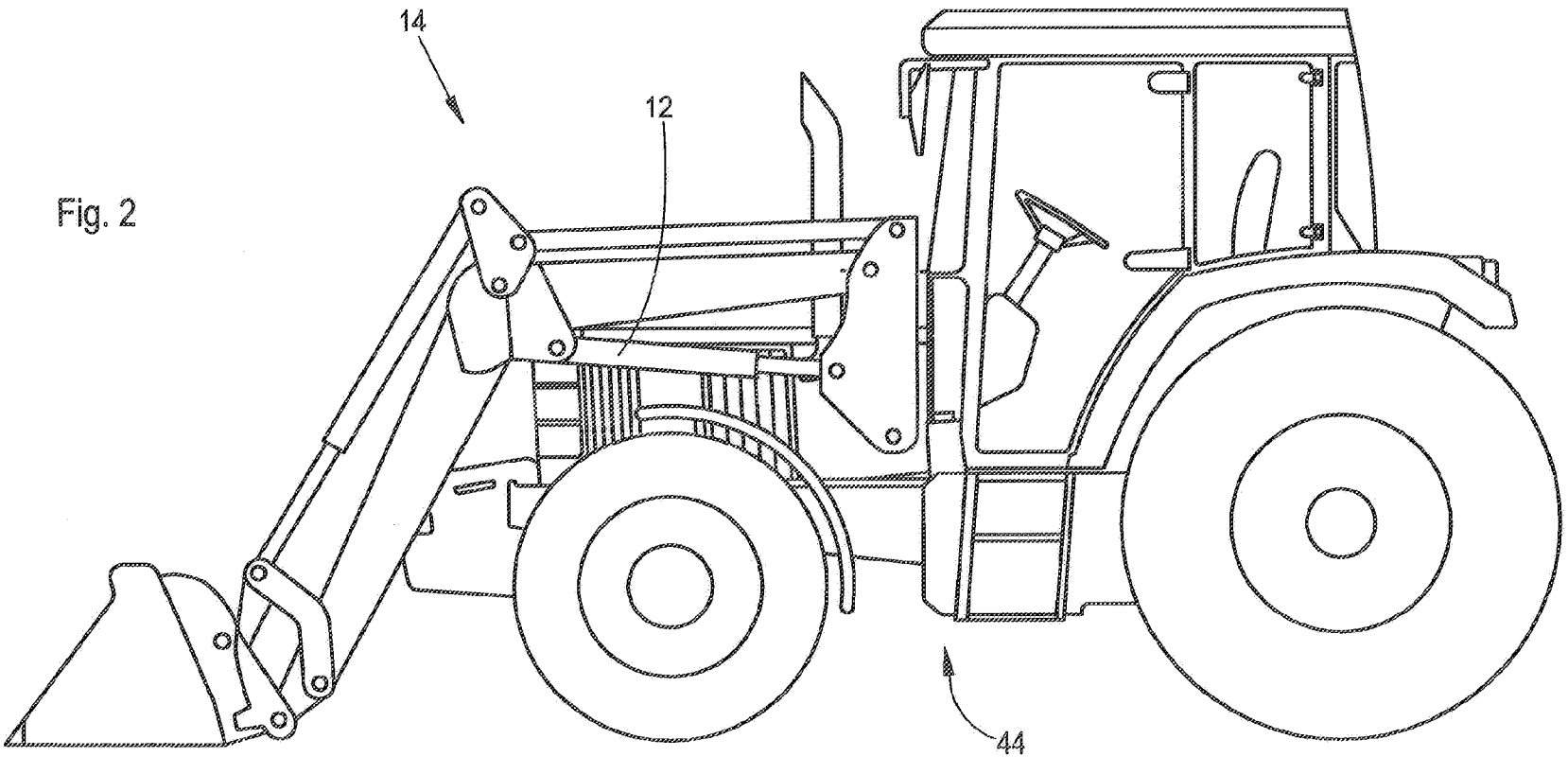
FIG. 2 shows an operating vehicle with a hydraulic system according to FIG. 1.

FIG. 2 shows an agricultural vehicle, such as a tractor 44 that is equipped with a front loader 14 that is operated by a hydraulic system 10. Other applications are also conceivable for the hydraulic system, according to the invention, for example for application in construction machines or telescopic loaders. The hydraulic system can also be used for the supply of hydraulic consumers not cited here explicitly, for example, for the supply of three point implement hitches for agricultural tractors.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A hydraulic system having an engine driven variable displacement hydraulic pump for supplying hydraulic fluid to a hydraulic consumer, an electronic control unit (ECU), and an adjustment member for adjusting pump displacement, the adjustment member being coupled to a piston, and the piston being engagable with a stop, characterized by:

the stop is coupled to an adjusting device which is controlled by the ECU, and the ECU controls the adjusting device as a function of a sensed speed of the engine; and the ECU reduces the maximum volume when a predetermined engine speed is exceeded.

2. The hydraulic system of claim 1, further comprising:

an operator control connected to the ECU, the ECU varying the maximum volume flow in response to the operator control independently of the engine speed.

3. The hydraulic system of the claim 1, further comprising:

a temperature sensor connected to the ECU, the ECU controlling the maximum volume flow as a function of the temperature sensed by the temperature sensor.

4. The hydraulic system of claim 1, wherein:

the adjusting device comprises an electric motor.

5. A hydraulic system having an engine driven variable displacement hydraulic pump for supplying hydraulic fluid to a hydraulic consumer, an electronic control unit (ECU), and an adjustment member for adjusting pump displacement, the adjustment member being coupled to a piston, and the piston being engagable with a stop, characterized by:

the stop is coupled to an adjusting device which is controlled by the ECU, and the ECU controls the adjusting device as a function of a sensed speed of the engine; and the ECU changes the maximum volume flow in proportion to the engine speed when a predetermined engine speed is exceeded, and the ECU reduces the maximum volume flow with increasing engine speed and increases the maximum volume flow with decreasing engine speed.

* * * * *